United States Patent [19]

Hernqvist

[11] Patent Number: 4,883,438

[45] Date of Patent: Nov. 28, 1989

[54] METHOD FOR SPOT-KNOCKING AN ELECTRON GUN MOUNT ASSEMBLY OF A CRT

[75] Inventor: Karl G. Hernqvist, Princeton, N.J.

[73] Assignee: RCA Licensing Corp., Princeton, N.J.

[21] Appl. No.: 336,609

[22] Filed: Mar. 29, 1989

Related U.S. Application Data

[63] Continuation-in-part of Ser. No. 214,554, Jun. 29, 1988, abandoned.

[51] Int. Cl.[4] ..... H01J 9/44

[52] U.S. Cl. ..... 445/5

[58] Field of Search ..... 445/5, 6

[56] References Cited

U.S. PATENT DOCUMENTS

| | | | |
|---|---|---|---|
| 3,772,554 | 11/1973 | Hughes | 313/69 C |
| 4,052,776 | 10/1977 | Maskell et al. | 445/5 |
| 4,076,366 | 2/1978 | Wardell et al. | 339/144 T |
| 4,127,313 | 11/1978 | Marks | 339/144 T |
| 4,214,798 | 7/1980 | Hopen | 445/5 |
| 4,326,762 | 4/1982 | Hockenbrock et al. | 445/5 |
| 4,515,569 | 5/1985 | Hernqvist | 445/5 |
| 4,682,962 | 7/1987 | Hata et al. | 445/5 |
| 4,682,963 | 7/1987 | Daldry et al. | 445/5 |
| 4,764,704 | 8/1988 | New et al. | 313/414 |

FOREIGN PATENT DOCUMENTS

| | | |
|---|---|---|
| 42-16005 | 9/1967 | Japan . |
| 54-2651 | 1/1979 | Japan . |
| 54-29966 | 3/1979 | Japan . |

*Primary Examiner*—Kenneth J. Ramsey

*Attorney, Agent, or Firm*—Joseph S. Tripoli; Dennis H. Irlbeck; Vincent J. Coughlin, Jr.

[57] ABSTRACT

The novel spot-knocking method for an electron gun mount assembly in an evacuated CRT comprises applying a spot knocking voltage between a first and second anode, and a first focus electrode with the remaining gun elements including a heater, a cathode, a control electrode, a screen electrode and a second focus electrode electrically floating.

9 Claims, 5 Drawing Sheets

METHOD FOR SPOT-KNOCKING AN ELECTRON GUN MOUNT ASSEMBLY OF A CRT

This is a continuation-in-part of application Ser. No. 214,554, filed June 29, 1988, now abandoned.

BACKGROUND OF THE INVENTION

The invention relates to a novel method for spot-knocking the electron gun mount assembly of a CRT (cathode-ray tube), and more particularly, to a method of spot-knocking an electron gun mount assembly having six electrodes.

In the manufacture of a CRT, it is the practice to electrically process the electron gun mount assembly therein after the CRT has been completely assembled, exhausted of gases and sealed. One step in this electrical processing is spot-knocking, which involves inducing arcing in the gaps between adjacent electrodes, usually between a focus electrode and an electrode adjacent thereto. Arcing removes projections, burrs and/or particles which would later be sites for the field emission of electrons during the normal operation of the CRT.

U.S. Pat. No. 4,214,798 issued to L. F. Hopen on July 29, 1980 discloses a spot-knocking method that may be applied to a bipotential or a tripotential electron gun structure. A bipotential gun structure typically has a heater and cathode K, a control grid G1, a screen grid G2, a single focus electrode G3 and a high voltage electrode, which is often designated as the anode or G4. Although separate elements may be provided for each of the three electron guns of a color picture tube, recent practice has tended to sue common elements for the G1, the G2, the G3 and the anode of the three electron guns. A tripotential gun differs from a bipotential gun in that it employs three focus electrodes for the focusing action instead of only one. A tripotential gun typically has a heater, a cathode K, a control grid G1, a screen grid G2, three focus electrodes G3, G4, and G5, and an anode, which is often designated G6. In the method described in the Hopen patent, the heater, the cathode, the control grid and the screen grid are interconnected and, in the bipotential gun structure, spot-knocking voltages are applied between the anode and the interconnected gun elements with the focus electrode electrically floating. The tripotential electron gun is similar to the bipotential electron gun for the purpose of spot-knocking except that the G3 and G5 focus electrodes are interconnected within the CRT and two separate stem leads are connected to the G3 and G4 focus electrodes which are electrically floating during spot-knocking.

Many methods of spot-knocking electron gun assemblies have been used previously in attempts to improve the electrical characteristics of television picture tubes. Most of these methods involve forcing arcs to occur between two adjacent electrodes to remove projections, burrs, and/or particles so that the field emission of electrons between the two elements is significantly reduced at the normal operating potentials. In all cases involving spot-knocking between the anode and the focus electrode G3, positive fluctuating DC high-voltage pulses are applied between these two electrodes with all other electrodes being held at ground potential or allowed to float, as described in the above-referenced Hopen patent. An alternative is to ground the anode and apply negative fluctuating DC high-voltage pulses to the remainder of the gun structure. The size, shape and repetition rate of the high-voltage pulses vary widely depending upon the nature of the spot-knocking equipment used. The voltage pulses used most frequently for spot-knocking are sinusoidal and are derived from the normal variation of the line voltage. They may be half wave with the lowest portion either at some minimum positive DC level or at ground potential, or they may be full wave, in which case the lowest value is usually clamped at ground potential. Very fast rise time pulses of short duration, sometimes derived from the discharge of a capacitor through a ball gap, have also been used in which current pulses often exceed 100 amperes. Although the power associated with these pulses is very high, the duration of each pulse (often less than one microsecond) limits the energy of the induced arc to levels which are safe for the tube elements. Regardless of the type of pulses used for the spot-knocking, most users have found it prudent to avoid the application of negative pulses to the anode.

In recent years, improvements in the focusing of the electron spot on the screen have been achieved by the use of increasingly higher voltages on the focusing elements of both bipotential and tripotential types. Because of these higher operating potentials, it is often necessary to provide for spot-knocking between the focus electrode G3 and the screen grid G2; for tripotential types, spot-knocking among the various focus grids G3, G4 and G5 is also believed to be desirable.

In another spot-knocking method, described in U.S. Pat. No. 4,052,776 to R. Maskell et al, very high amplitude RD bursts are added to the fluctuating DC pulses of relatively low amplitude which are used to spot-knock between G2 and G3. In this method, the fluctuating DC spot-knocking voltage pulses are introduced through the stem lead to the G3 and G5 of a tripotential gun, and the RF burst is introduced through the remainder of the stem leads which are electrically connected. Because the stem leads are close to one another, either the peak DC voltage must be maintained at relatively low values which are of limited effectiveness, or special precautions must be taken to prevent electrical breakdown among the external portions of the stem leads.

Yet another spot-knocking method is described in U.S. Pat. No. 4,682,963 to Daldry et al. A two-step conditioning process is disclosed for a CRT having six grids. During normal operation the G2 and G4 are interconnected to a relatively low voltage. The G3 and G5 focus electrodes are interconnected at a higher potential and the anode, G6, operates at the highest potential. A general conditioning includes applying high voltage DC to the anode and applying pulse voltages to the interconnected G2 and G4 electrodes. The heater, the cathode, and the G1 are interconnected and allowed to float. The G3 and G5 are interconnected to each other and also allowed to float. During the second step of the processing, the heater, the cathode and the G1 through G5 electrodes, inclusive, are connected to the pulse voltage with a high voltage DC applied to the anode.

While several of the above-described spot-knocking methods relate to six element electron guns (in addition to the heater and the cathode), none provides an adequate means for conditioning a double bipotential electron gun or a six-element electron gun having two screen grids and two focus electrodes. A double bipotential gun structure typically has a heater, a cathode K, a control grid G1, a screen grid G2, a first focus electrode G3, a first anode G4, a second focus electrode G5 and a second anode G6. The first and second focus electrodes G3 and G5 typically operate at about 7 kV and the first and second anode, G4 and G6, operate at about 25 kV. One type of six-element electron gun structure includes (in addition to the heater and cathode) a control grid G1, a first screen grid G2, a first focus electrode G3, a second screen grid G4, a second focus electrode G5 and an anode G6. The first and second screen grids, G2 and G4, typically operate at about 300 V to 1000 V, the first and second focus electrodes, G3 and G5, operate at about 7 kV and the anode G6, operates at about 25 kV.

SUMMARY OF THE INVENTION

The novel method for spot-knocking an electron gun mount assembly in an evacuated CRT comprising a plurality of gun elements including a heater, a cathode, a control electrode, at least one screen electrode, a first focus electrode, a second focus electrode an anode, includes applying a spot-knocking voltage between said anode and said first focus electrode, the remaining gun elements being electrically floating.

DETAILED DESCRIPTION OF THE PREFERRED EMBODIMENTS

The novel spot-knocking method may be applied to any electron gun mount assembly of a cathode-ray tube, CRT, having a cathode and a plurality of electrodes for directing and focusing an electron beam, wherein at least two of the electrodes operate at the same potential.

There may be a single electron gun or a plurality of guns in the mount assembly of the CRT. Where there is more than one gun, the guns may be in any geometric arrangement. Where there are three guns, as in a color television picture tube, for example, the guns may be arranged in a delta array or in an in line array as is known in the art.

Figure 1:
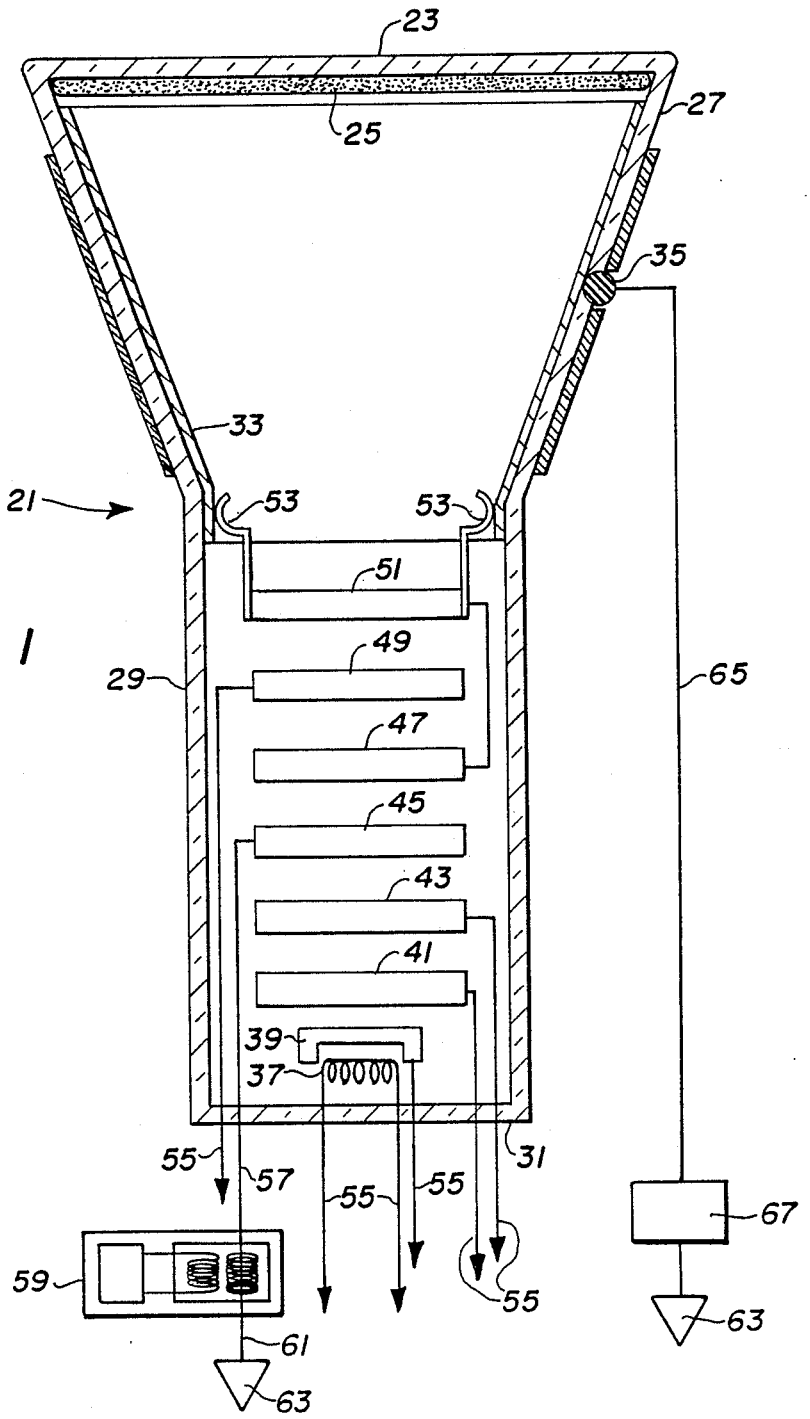
FIG. 1 shows a schematic representation of a first circuit arrangement for practicing the novel method on a first electron gun.

The novel method may be applied, for example, to a double bipotential electron gun of the type schematically represented in FIG. 1. The double bipotential gun structure typically has a heater, a cathode, a G1 or control grid electrode, a G2 or screen grid electrode, a G3 or first focus electrode, a G4 or first anode, a G5 or second focus electrode and a G6 or second anode. Although separate elements may be provided for each of the three electron guns of the CRT, recent practice has tended to use common elements attached to glass support rods (not shown). In the double bipotential electron gun, the focus electrodes G3 and G5 typically operate at a first voltage of about 7 kV, and the anodes G4 and G6 operate at a second voltage of about 25 kV.

The double bipotential electron gun of the present invention utilizes a glass stem (not shown) having sufficient leads (or pins) to permit both the G3 and G5 electrodes to be connected to separate leads despite the fact that during normal tube operation the G3 and G5 electrodes operate at a common voltage of about 7 kV. The separate leads exiting the evacuated tube envelope permit the novel spot-knocking method to be utilized.

FIG. 1 includes a schematic, sectional, elevational view of an evacuated CRT 21 including a faceplate panel 23 carrying on its inner surface a luminescent viewing screen 25. The panel 23 is sealed to the larger end of a funnel 27 having a neck 29 integral with the smaller end of the funnel 27. The neck 29 is closed by a stem 31. The inner surface of the funnel 27 carries a conductive coating 33 which contacts an anode button 35.

the neck 29 houses a double bipotential electron gun mount assembly. This assembly includes three double bipotential guns only one of which is shown in FIG. 1. The mount assembly includes two glass support rods (not shown) from which the various gun elements are mounted. The gun elements of each gun include a heater 37, a cathode 39, a G1 or control electrode 41, a G2 or screen electrode 43, a G3 or first focus electrode 45, a G4 or first anode 47, a G5 or second focus electrode 49, and a G6 or second anode 51. The first and second anodes, 47 and 51, respectively, are internally electrically interconnected, and the second anode 51 is connected to the conductive coating 33 by means of snubbers 53.

In the preferred embodiment, the heater 37, the cathode 39, the G1 electrode 41, the G2 electrode 43 and the G5 electrode 49 are connected to separate stem leads 55 which extend through the stem 31. The G3 electrode 45 is also connected to a separate G3 lead 57 which extends through the stem. During spot-knocking, the stem 31 and the stem leads 55 and 57 are inserted into a base (not shown), and the leads 55 are electrically floating. A source 59 of high frequency voltage pulses of short duration and fast rise time is inserted in a socket led 61 between the socket and ground 63. The pulses comprise between 92 and 150 kilovolts (kV) of AC of about 350 kilohertz. The anode button 35 is connected through an anode lead 65 to a source 67 of about +45 kV potential. The anode potential is applied to the internally interconnected anodes 47 and 51. The base (not shown) comprises an insulating silo which houses and electrically isolates the portion of the G3 lead 57 which is outside the CRT. This type of base is described in U.S. Pat. Nos. 4,076,366 to M. H. Wardell et al and 4,127,313 to B. G. Marks, for example. The high frequency voltage from the source 59 forces arcing and imparts a high voltage whereby gas molecules in the vicinity of the electrodes are efficiently ionized, and the gas ions and arcs effectively remove undesirable debris from the surfaces of the facing electrodes.

Figure 2:
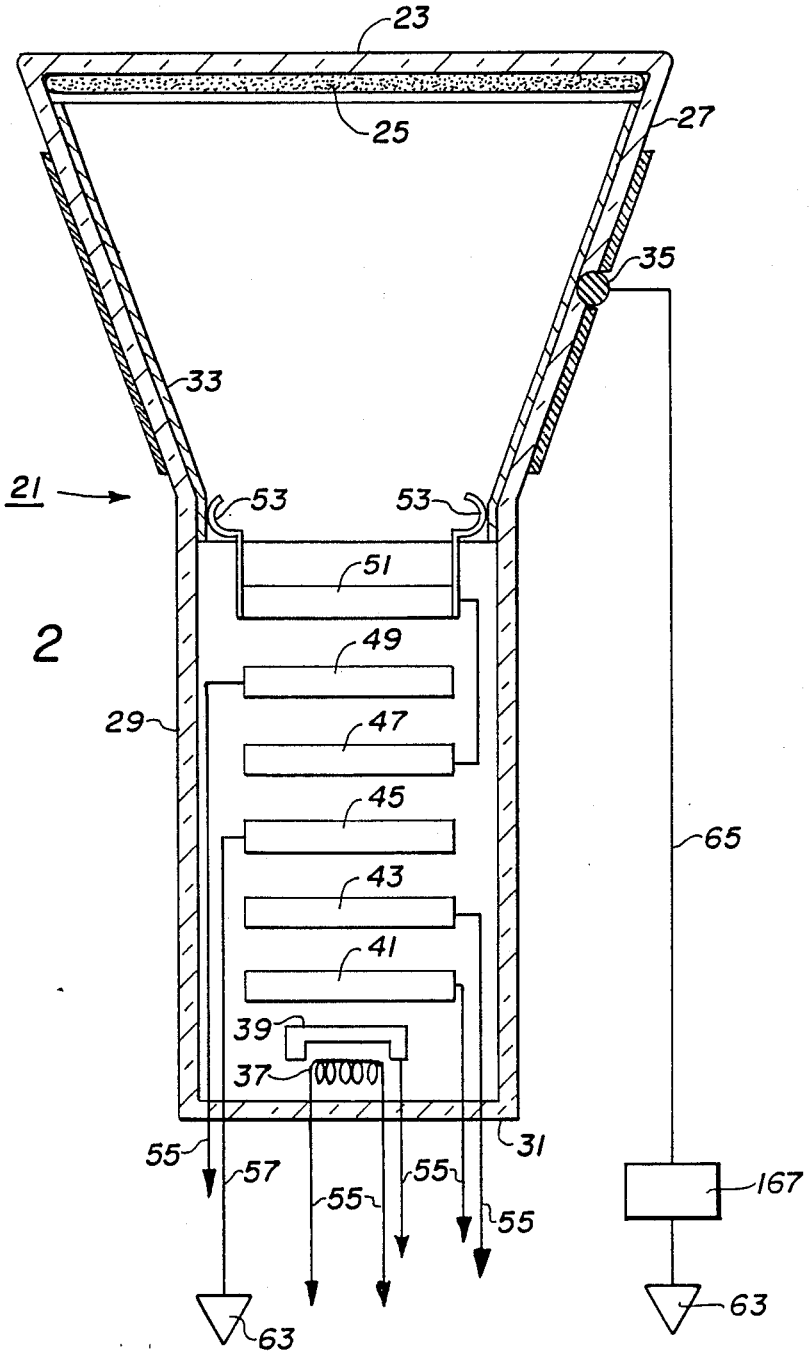
FIG. 2 shows a schematic representation of a second circuit arrangement for practicing the novel method on the electron gun of FIG. 1.

An alternative method of spot-knocking is shown in FIG. 2. The structure is similar to that shown in FIG. 1 and identical elements are identified by the same numbers used in FIG. 1. During spot knocking the stem 31 and the stem leads 55 and 57 are inserted into the base (not shown), and the leads 55 are electrically floating. Unlike the method of FIG. 1, the socket lead connects the G3 lead 57 directly to ground 63. The anode button 35 is connected through the anode lead 65 to a source 167 of low frequency pulsed spot-knocking voltage and then to ground 63. The pulses from the source 167 rise initially from ground to peaks of about minus 35±5 kilovolts increasing to peaks of about minus 60±5 kilovolts in about 90 to 120 seconds. The pulses are comprises of half-wave rectified AC voltage having a frequency of about 60 hertz. The positive portion of the AC voltage is clamped to ground. The total duration of the pulses may be in the range of 0.1 to 0.2 seconds (6 to 12 cycles) and the time spacing may be in the range of 0.5 to 1.0 second.

Figure 3:
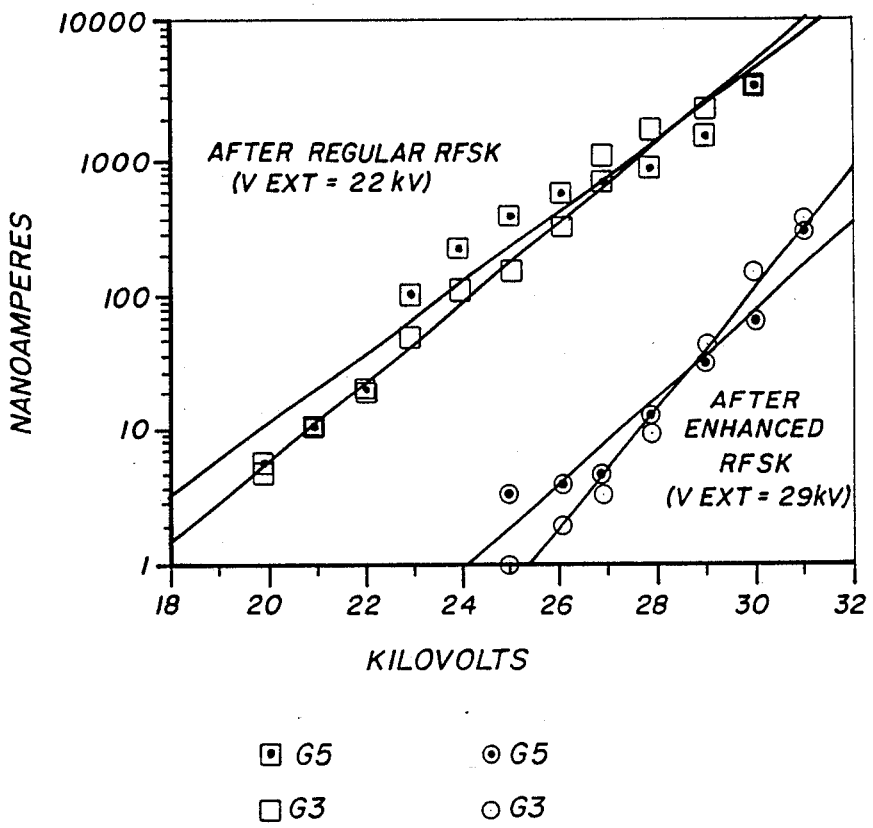
FIG. 3 shows a graph comparing the stray emission after spot-knocking by the conventional and the novel method.

FIG. 3 shows the results of radio frequency spot-knocking (RFSK) tests. The "regular" RFSK was performed with the G3 and G5 electrodes floating, the heater, cathode, G1 and G2 electrodes grounded and the spot-knocking voltages of the alternative method applied to the anode button 35. The "enhanced" RFSK was performed according to the alternative method with the heater, cathode, G1, G2 and G5 electrodes floating and only the G3 electrode grounded. The spot-knocking voltages of the alternative method are applied to the anode button 35. As shown in FIG. 3, the novel method permits the G3 and G5 focus electrodes to be operated at voltages up to 29 kV (extinction voltage, V EXT) without introducing any visible (stray) emission, e.g. above about 40 nanoamperes, from the electrodes, whereas regularly spot-knocked electrodes exhibited stray emission at voltages equal to, or exceeding 22 kV.

Figure 4:
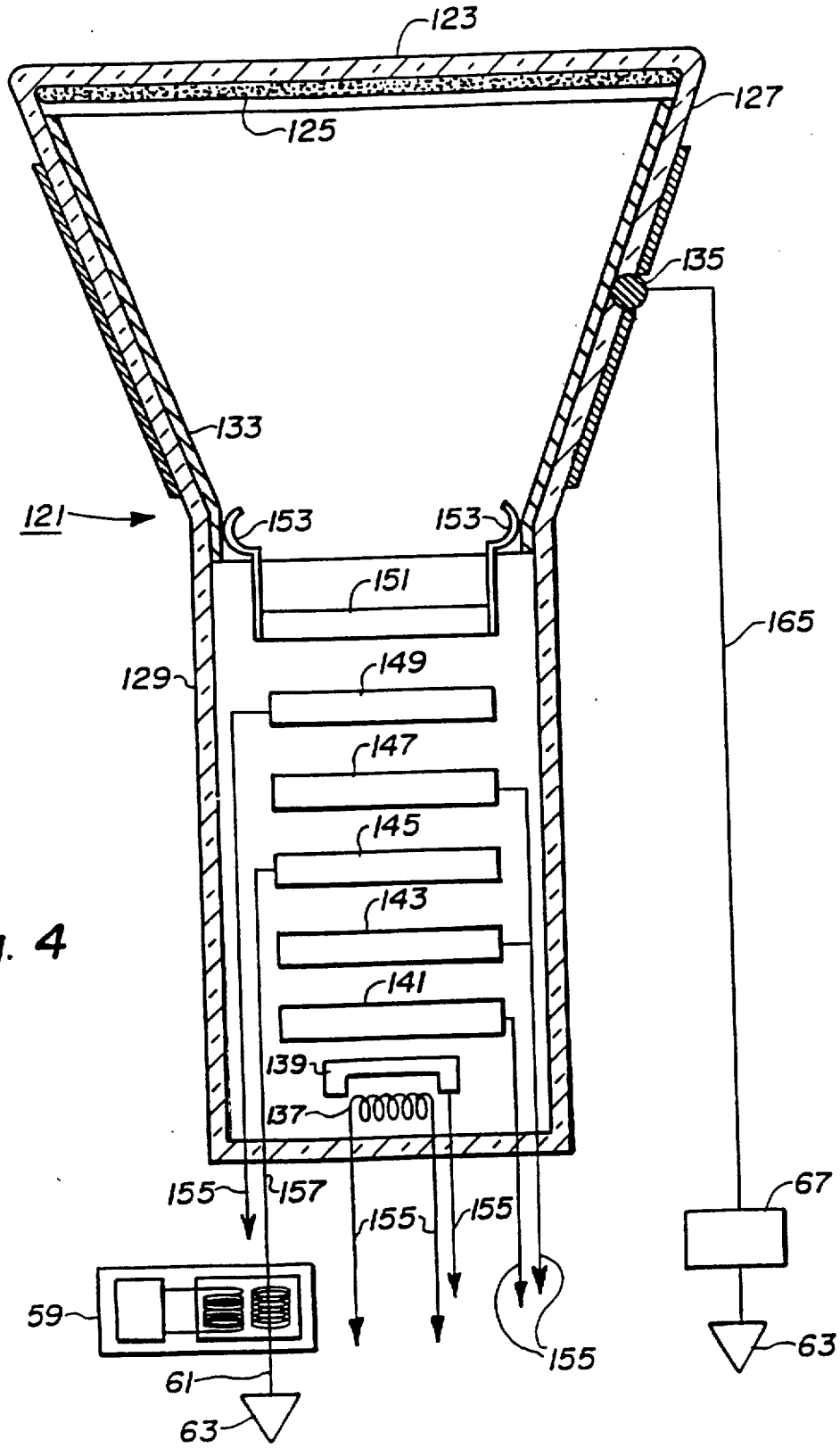
FIG. 4 shows a schematic representation of a third circuit arrangement for practicing the novel method on a second electron gun.

The spot-knocking method described herein also is applicable to six-element electron gun structures (not including heaters and cathodes) of the type schematically represented in FIG. 4 which shows a sectional, elevational view of an evacuated CRT 121 including a faceplate panel 123 carrying on its inner surface a luminescent viewing screen 125. The panel 123 is sealed to the larger end of a funnel 127 having a neck 129 integral with the smaller end of the funnel. The neck 129 is closed by a stem 131. The inner surface of the funnel 127 carries a conductive coating 133 which contacts an anode button 135.

The neck 129 houses a six-element electron gun mount assembly which includes three electron guns only one of which is shown in FIGURE 4. The mount assembly includes two glass support rods (not shown) from which the various gun elements are mounted. Each electron gun includes a heater 137, a cathode 139, a G1 or control electrode 149, a G2 or first screen grid 143, a G3 or first focus electrode 145, a G4 or second screen grid 147, a G5 or second focus electrode 149 and a G6 or anode 151. The first and second screen grids 143 and 147, respectively, are internally interconnected and the first and second focus electrodes 145 and 149, which operating at the same electrical potential, have separate stem leads, as described hereinafter, to facilitate spot-knocking. The anode 151 is connected to the conductive coating 133 by means of snubbers 153. An electron gun of this type is shown in U.S. Pat. No. 4,764,704, issued to D. A. New et al., on Aug. 16, 1988.

In the embodiment of FIG. 4, the heater 137, the cathode 139, the G1 electrode 141, the interconnected G2 and G4 electrodes 143 and 147, and the G5 electrode 149 are connected to separate stem leads 155 which extend through the stem 131. The G3 electrode 145 is also connected to a separate lead 157 which extends through the stem. During spot-knocking, the stem 131 and the stem leads 155 and 157 are inserted into a base (not shown), and the leads 155 are electrically floating.

A source 59 of high frequency voltage pulses of short duration and fast rise time, identical to that described with respect to FIG. 1, is inserted in a socket lead 61 between the socket and ground 63. The pulses comprise between 92 and 150 kilovolts (kV) of AC of about 350 kilohertz. The anode button 135 is connected through an anode lead 165 to a source 67 of about +45 kV potential. The source 67 also is identical to that described in FIG. 1. The anode potential is applies to the anode 151. The base (not shown) comprises an insulating silo (also not shown) which houses and electrically isolates the portion of the G3 lead 157 which is outside the CRT. This type of base is described in U.S. Pat. Nos. 4,076,366 to M. H. Wardell et al. and 4,127,313 to B. G. Marks, for example. The high frequency voltage from the source 59 forces arcing and imparts a high voltage whereby gas molecules in the vicinity of the electrodes are efficiently ionized, and the gas ions and arcs effectively remove undesirable debris from the surfaces of the facing electrodes.

Figure 5:
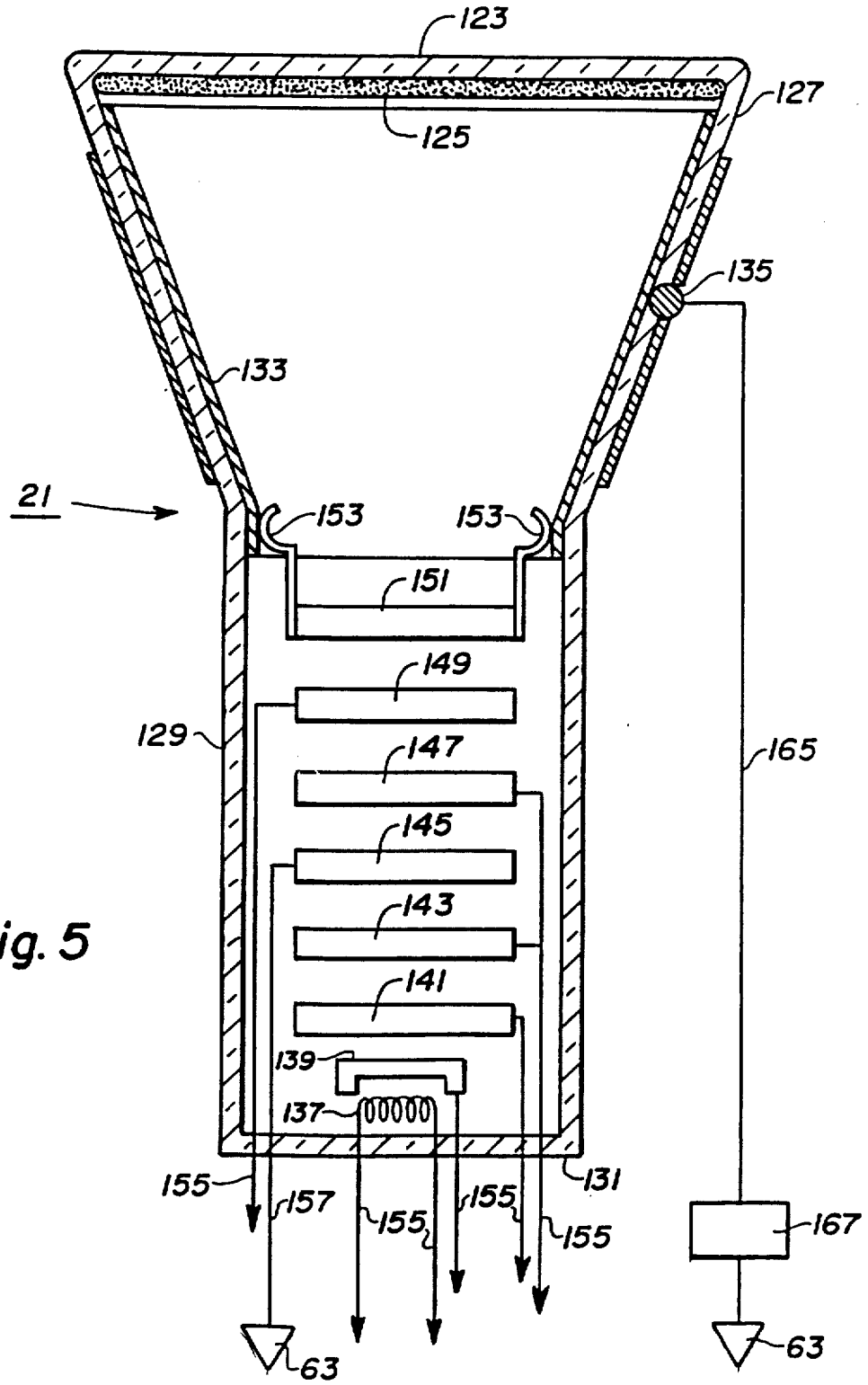
FIG. 5 shows a schematic representation of a fourth circuit arrangement for practicing the novel method on the electron gun of FIG. 4.

Yet another method of spot-knocking is shown in FIG. 5. The structure is similar to that shown in FIG. 4 and identical elements are identified by the same numbers used in FIG. 4. During spot-knocking the stem 131 and the stem leads 155 and 157 are inserted into the base (not shown), and the leads 155 are electrically floating. Unlike the method of FIG. 4, the socket lead connects the G3 lead 157 directly to ground 63. The anode button 135 is connected through the anode lead 165 to a source 167 of low frequency pulsed spot-knocking voltage and then to ground 63. The pulses from the source 167 rise initially from ground to peaks of about minus 35±5 kilovolts increasing to peaks of about minus 60±5 kilovolts in about 90 to 120 seconds. The pulses are comprised of half-wave rectified AC voltage having a frequency of about 60 hertz. The positive portion of the AC voltage is clamped to ground. The total duration of the pulses may be in the range of 0.1 to 0.2 seconds (6 to 12 cycles) and the time spacing may be in the range of 0.5 to 1.0 second.

What is claimed is:

1. A method for spot-knocking an electron gun mount assembly in an evacuated CRT, said mount assembly comprising a plurality of gun elements including a heater, a cathode, a control electrode, a screen electrode, a first focus electrode, a first anode, a second focus electrode and a second anode, said method comprising the step of applying spot-knocking voltages between said first and second anodes, and said first focus electrode, the remaining gun elements being electrically floating.

2. The method defined in claim 1 wherein said first focus electrode being electrically grounded during spot-knocking.

3. The method defined in claim 1 wherein said first focus electrode being electrically connected to a source of high frequency voltage pulses of short duration and fast rise time.

4. A method for spot-knocking an electron gun mount assembly in an evacuated CRT, said mount assembly comprising a plurality of gun elements including a heater, a cathode, a control electrode, at lest one screen grid, a first focus electrode, a second focus electrode and an anode, said method comprising the step of applying a spot-knocking voltage between said anode and said first focus electrode, the remaining gun elements being electrically floating.

5. The method defined in claim 4 wherein said first focus electrode being electrically grounded during spot-knocking.

6. The method defined in claim 4 wherein said first focus electrode being electrically connected to a source of high frequency voltage pulses of short duration and fast rise time.

7. A method for spot-knocking an electron gun mount assembly in an evacuated CRT, said mount assembly comprising a plurality of gun elements including a heater, a cathode, a control electrode, a first screen grid, a first focus electrode, a second screen grid, a second focus electrode and an anode, said method comprising the step of applying a spot-knocking voltage between said anode and said first focus electrode, the remaining gun elements being electrically floating.

8. The method defined in claim 7 wherein said first focus electrode being electrically grounded during spot-knocking.

9. The method defined in claim 7 wherein said first focus electrode being electrically connected to a source of high frequency voltage pulses of short duration and fast rise time.

* * * * *

UNITED STATES PATENT AND TRADEMARK OFFICE
CERTIFICATE OF CORRECTION

PATENT NO. : 4,883,438

DATED : Nov. 28, 1989

INVENTOR(S) : Karl G. Hernqvist

It is certified that error appears in the above-identified patent and that said Letters Patent is hereby corrected as shown below:

Patent

Col. 1, line 33, change "sue" to --use--.

Col. 2, line 31, change "RD" to --RF--.

Col. 2, line 39, change "voltage" to --voltages--.

Col. 3, line 19, after "electrode", second occurrence, add --and--.

UNITED STATES PATENT AND TRADEMARK OFFICE
CERTIFICATE OF CORRECTION

PATENT NO. : 4,883,438

DATED : Nov. 28, 1989

INVENTOR(S) : Karl G. Hernqvist

It is certified that error appears in the above-identified patent and that said Letters Patent is hereby corrected as shown below:

Patent

Col. 3, line 53, change "in line" to --inline--.

Col. 4, line 41, change "led" to --lead--.

Col. 5, lines 3 and 4, change "comprises" to --comprised--.

Col. 6, line 7, change "applies" to --applied--.

Signed and Sealed this

Twentieth Day of November, 1990

*Attest:*

*Attesting Officer*

HARRY F. MANBECK, JR.

*Commissioner of Patents and Trademarks*

UNITED STATES PATENT AND TRADEMARK OFFICE

CERTIFICATE OF CORRECTION

PATENT NO. : 4,883,438

DATED : Nov. 28, 1989

INVENTOR(S) : Karl G. Hernqvist

It is certified that error appears in the above-identified patent and that said Letters Patent is hereby corrected as shown below:

The drawing sheets, consisting of Figs. 4 and 5, as shown on the attached pages, should be added.

Signed and Sealed this

Nineteenth Day of October, 1993

Bruce Lehman

*Attest:*

BRUCE LEHMAN

*Attesting Officer*

*Commissioner of Patents and Trademarks*